US007309305B2

(12) United States Patent
Nichols

(10) Patent No.: US 7,309,305 B2
(45) Date of Patent: Dec. 18, 2007

(54) APPARATUS FOR STRETCHING HAMSTRINGS

(76) Inventor: Steven M. Nichols, 6551 Sherwood La., Boston, NY (US) 14025

( * ) Notice: Subject to any disclaimer, the term of this patent is extended or adjusted under 35 U.S.C. 154(b) by 27 days.

(21) Appl. No.: 11/229,207

(22) Filed: Sep. 16, 2005

(65) Prior Publication Data

US 2007/0066464 A1 Mar. 22, 2007

Related U.S. Application Data

(63) Continuation-in-part of application No. 11/023,877, filed on Dec. 24, 2004.

(51) Int. Cl.
*A63B 23/00* (2006.01)

(52) U.S. Cl. ..... 482/148; 482/907; 128/25

(58) Field of Classification Search ..... 482/907, 482/134, 148, 91, 140, 79–80, 131, 137; 601/5, 23–36, 60; 128/25 R, 882, 25 B, 128/68, 80

See application file for complete search history.

(56) References Cited

U.S. PATENT DOCUMENTS 5,236,333 A * 8/1993 Barba, Jr. ..... 601/34
5,547,446 A * 8/1996 Szabo ..... 482/121
6,027,434 A * 2/2000 Gibbons ..... 482/131
6,203,473 B1 * 3/2001 Atwood ..... 482/95
2003/0040409 A1 2/2003 Lindquist
2003/0224912 A1 * 12/2003 Zagone ..... 482/80
2004/0180764 A1 9/2004 Patton
2005/0209067 A1 * 9/2005 Backes et al. ..... 482/91

* cited by examiner

*Primary Examiner*—Lori Amerson
(74) *Attorney, Agent, or Firm*—Patricia M. Costanzo

(57) ABSTRACT

A size-adjustable, foldable hamstring stretching apparatus of unitary construction provides for easily, effectively, and efficiently exercising (stretching) the hamstrings. The apparatus consists of a unitary frame and is used in a prone position, thus, avoiding back strain. The apparatus provides means for supporting the user's foot and means for assuring that the user's leg is maintained in a straight position. Means for holding allows for ease in grasping the apparatus allowing the user to pull or push the apparatus as desired. The means for supporting a foot, maintaining the leg in a straight position, and for holding may all be padded or made of a soft material for increased ease of use and comfort. The frame is made of any strong, lightweight material, such as plastic or aluminum and it is contemplated that the apparatus be made using a molding process to reduce the cost of manufacturing.

20 Claims, 8 Drawing Sheets

Hamstretch Device

Two parts of adjustable Hamstretch device.

Adjustable Hamstretch Device

APPARATUS FOR STRETCHING HAMSTRINGS

CROSS-REFERENCE TO RELATED APPLICATIONS

This Continuation-in-Part Application claims the benefit of U.S. Non-Provisional Application Ser. No. 11/023,877, filed Dec. 24, 2004.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to exercise apparatus and, more particularly, to a size-adjustable, foldable hamstring stretching exercise apparatus that provides for effective low-impact stretching of an individual's hamstrings while the individual is in a safe, comfortable, prone position, which position eliminates back stress.

The background information discussed below is presented to better illustrate the novelty and advantages of the present invention. This background information is not admitted prior art.

"Hamstring" commonly refers to any of three muscles at the back of the thigh that function to flex and rotate the leg and extend the thigh, although it is not uncommon to hear the term "hamstring" also used to refer to either of two groups of tendons at the back of the human knee. In either or both cases, maintaining the flexibility of this muscle and/or tendon group is important. It is well-known that as people age their muscles frequently loose there flexibility. Moreover, underutilization of any muscle group by people of any age will result in atrophy of that muscle. When muscles, especially the hamstrings, become less flexible and start to atrophy, the risk of injury to these muscles increases. Injured hamstring muscles and tendons, by limiting a person's mobility, may seriously impair the quality of daily life. Healthy muscles and tendons seem to benefit everyone, but senior citizens, especially, seem to benefit a great deal from preserving the flexibility of their hamstrings. Maintaining the vitality of their hamstrings usually results in maintaining their mobility and in some cases even increasing their mobility, which often provides for seniors to maintain their independence for longer periods of time.

Hamstring injuries, however, are of course, not limited to older persons. If a younger person's hamstrings are not properly conditioned by regular stretching, they are also prone to injury. This is one reason why athletes or dancers, prior to an event or performance, make it a point to take the time to perform warm-up exercises, such as stretching and bending. Without these conditioning exercises their muscles would not operate effectively and safely.

There are a number of specific stretching exercises that are useful for properly conditioning the hamstrings. One of these exercises requires a person to lean forward toward a wall and to place their hands on the wall for support while keeping one leg relatively straight and stretching the other leg out behind them. While in this position, th e heel of the rearward held foot is brought as close to the ground as possible. Another stretching exercise requires the exerciser to lie prone on his or her back, raising one leg toward the ceiling and grabbing hold of the raised leg and pulling it as far as possible toward their torso. Yet still another stretching exercise is for one to sit on the floor with legs spread out and to take turns bending the torso down toward each leg and/or to the area of the floor between one's stretched legs, and to hold that position for as long as comfortable.

These methods of stretching the hamstring, however, are difficult for many people to perform as these exercises require a relatively high degree of mobility and flexibility. If one is older, or suffering from an injury that has limited this type of activity for any significant period of time, it is highly likely that he or she will lack the necessary degree of flexibility and mobility to achieve the required stretch. However, avoiding stretching exercises will only further compound the problem, for as with all muscles, the longer the hamstring remains inactive, the weaker and more foreshortened it becomes, and, thus, more prone to injury.

Attempts to alleviate the problems associated with stretching the hamstrings have been made. There are a number of means available for those who either desire to increase the flexibility of their hamstrings, or are required to do so in order to rehabilitate an injured hamstring muscle, or because of other physical reasons. These means include a variety of devices that, while varying in structure and operation, are all designed to provide a way for people to obtain the benefits of exercising the hamstring, while attempting to reduce the amount of physical effort required.

There are, however, a number of problems with such devices. Many of them are quite unwieldy, having a number of pulleys, elastic bands, cables, or other moving parts that must be attached to fixed surfaces before they are ready for use. In some cases, these parts, especially the pulleys, may add weight to the apparatus, making it less useable for those who are not as strong as the average person. Moreover, required moving parts provide opportunities for an apparatus to malfunction or to cease to work altogether, as well as likely presenting a need for frequent replacement, and increasing the overall cost of manufacturing the apparatus, which cost will inevitably be passed on to the consumer. Importantly, such devices must be anchored to something fixed prior to use and, thus, are difficult, if not impossible, to freely relocate, as desired.

An additional factor, created by the complexity of some of these apparatuses, is the need for a prospective user of the apparatus to obtain help in learning to use the device, in setting-up the device, and/or in using the device. When using exercising equipment in a gym or other more public location, there is usually ample opportunity for an exerciser to find assistance when needed. In the privacy of one's home that opportunity is generally not available. Many of the hamstring stretching devices presently available require the person performing the exercise to have another person near by to provide the pressure that may be required to keep the exercise's leg from bending while the exercising person is performing a given exercise. This requirement further limits a user's ability to use such apparatuses whenever the user wishes and may be enough of a detriment to discourage use of the apparatus.

Yet still another problem with many of the apparatuses presently available is the amount of strength required, on the part of a user, to get the apparatus to function. Even the simplest of these apparatuses, often requires a user to exert a strong arm pull to get any benefit from the apparatus.

While this may well be within the capacity of a younger and more robust person, those who may benefit most from the apparatus, namely the elderly or those in a weakened condition, are most likely to have considerable difficulty in exerting the required pull, unless given assistance.

In order to derive the optimum benefit from these apparatuses the leg being exercised must be kept straight. If the knee is allowed to bend while the hamstrings are being stretched, the hamstrings are caused to relax, thus, experiencing no tension and receiving no benefit from the stretch. Few, if any of the apparatuses presently available for working the hamstrings, provide for means to keep the knee straight, thus permitting, or even encouraging, improper use of the apparatus, resulting in little, if any, benefit from its use.

Moreover, the apparatuses currently available bring into play muscle groups of the lower back. In order to operate the pulleys, ropes, or other mechanical means present in many of these apparatuses, a user is required to bend from the lower back, which places a tremendous strain on the back. For many users, such movements create a potential for back injury, especially if the individual's muscles lack tone and strength, or if the individual previously suffered back problems. Such potential problems are often a source of anxiety about using the current apparatuses by people who would benefit from their use the most.

A further important issue relating to the use of the presently available apparatuses is that of cost. The more complicated the apparatus the more costly it is likely to be. Similarly, if a apparatus is comprised of many parts, the number of parts is usually indicative of the cost. The larger apparatuses that are often found in health centers are often prohibitively expensive for home use.

Accordingly, it would be a significant improvement in the art to provide for a simple, lightweight, portable, foldable, size-adjustable hamstring stretching apparatus, with no moving parts; one that does not require outside assistance to use; which keeps the leg straight preventing bending of the knee; allows the user to remain in a relaxed position so that no stress is placed on the lower back; provides an optimal stretch for the hamstring, and because of its simplicity is inexpensive to manufacture and, thus, is affordable to most all people.

SUMMARY

The present invention satisfies the urgent need in the art for a size-adjustable, foldable hamstring stretching apparatus that eliminates the complexities of the current stretching apparatuses. The apparatus is of simple construction, as it comprises a unitary frame, requiring only economical manufacturing methods. Moreover, the apparatus may be made of many available and inexpensive materials, such as any suitable metal or plastic, thus making the apparatus attractively affordable. The hamstring stretching apparatus, according to the principals of the present invention, allows the user to use the apparatus at their own convenience, without any of the concerns so frequently found with other hamstring stretching apparatuses.

Because of its simple construction and because the apparatus may be made from any strong, lightweight material, it is lightweight and easily transported. The present invention requires none of the moving parts that are so prevalent in so many of the currently available hamstring stretching apparatuses, thus, removing the concerns of the moving parts breaking or requiring periodic replacement.

The simple unitary frame construction of one preferred embodiment, provides for the present invention to be easily adjusted accommodating the size of the user. Instead of having to adjust cables and the tension of various elastic bands to adjust the size of the present invention, it relies only on the presence of at least one spring-like locking pin on one frame part of the apparatus and a series of several strategically positioned apertures, on another fame part of the apparatus, where each aperture may accept the at least one spring like locking pin. The aperture series provides for the frame to be sizably adjusted, allowing for a perfect fit. In addition to the benefits of adjustability, the ability to fold the apparatus of the present invention offers ease of portability. These benefits make it easier for users to maintain healthy and exercised hamstrings.

One of the key factors in exercising the hamstrings is keeping the leg being exercised straight, that is, not permitting the knee to bend, which is not a focal point of most of the hamstring stretching apparatuses presently available. The current invention remedies this, by preventing bending of the knee, thus providing for an effective and efficient stretch of the hamstrings.

Importantly, the current invention is easy for all to use and allows the user to determine and control the amount of stress the user desires the hamstrings to experience. While many conventional hamstring stretching devices require users to bend from the waist while either standing or sitting causing stress on the lower back, the current invention requires the user to perform the hamstring stretching exercise in a prone position, assuring that the user's back is always fully supported. In fact, given the design of the apparatus as taught herein, no assistance is required to use the apparatus, such as having an assistant hold the exercise's leg straight, which assistance is required while using many of the conventional apparatuses. The invention as described herein provides for ease of use, as its operation requires only minimal pushing or pulling on the handle holding means, which is desirable for people with limited upper body strength. Other hamstring stretching apparatuses require the user to either pull with their legs as dead weight, or hold bands while pushing with the leg.

All of these advances and advantages are made available by providing an apparatus for stretching hamstring muscles in a prone position, comprising:

a means for holding;

a means for supporting a foot, and a means for maintaining a straight leg, where the means for holding, the means for supporting a foot, and the means for maintaining a straight leg are functionally inter-connected forming a unitary frame.

Moreover, one preferred embodiment, the apparatus may be made foldable and size adjustable. In another preferred embodiment the means for holding of one embodiment is contemplated to be a handle for grasping with one's hands which may be padded. Additionally, the means for supporting a foot and the means for maintaining a straight leg may be padded, if desired. The unitary frame of the apparatus may be made of any suitable material, such as a metal, more specifically a light-weight aluminum, or it may be made from a suitable plastic or a fiberglass. In yet another preferred embodiment, the means for holding is a section of the frame.

In addition, a method for stretching hamstring muscles while lying in a prone position is provided and comprises the steps of:

providing a means for holding;

providing a means for supporting a foot, and providing a means for maintaining a straight leg, where the means for holding, the means for supporting a foot, and the means for maintaining a straight leg are functionally connected to form a one-piece frame assembly for:

holding the means for holding using one's hands, supporting a foot in the means for supporting a foot;

keeping the leg straight by preventing the knee from bending in the means for maintaining a straight leg, and lifting the foot that is supported in the means for supporting the foot upwards by pulling the means for holding toward the user, therein effectively stretching the hamstring muscle.

Another favored embodiment comprises a size-adjustable apparatus comprising:

at least a first part, and at least a second part, where the second part is reversibly separable from said first part, and where the first part has at least a first end adapted for slideably receiving and positionally and reversibly maintaining a first end of the second part providing for size adjustability of said unitary frame. The size-adjustable apparatus may further comprise:

a) at least one locking pin means functionally positioned on the first end of the second part, and b) at least two apertures functionally positioned on the first end of the first part for receiving the at least one locking pin providing for lockable size adjustability of the apparatus.

Another favored embodiment comprise wherein the apparatus may foldable and/or size-adjustable. The folding apparatus comprises a) a first frame part;

b) a second frame part, and c) a third frame part, wherein said first frame part is hingedly attached to second frame part via attaching hinges, wherein second frame part is hingedly attached to third frame part via attaching hinges, wherein said hinged attachments provide for the hamstring stretching apparatus to be foldable.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figure 1A:
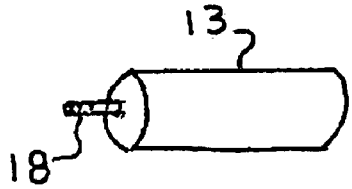
FIG. 1*a* is a side view showing the bolt part of an attachment means.

Closed Frame: as used herein, refers to a frame structure that could be likened to a circle, the letter "O", or to a hula hoop. One example of a device comprising a closed frame that is also a "shaped closed frame" is an oven rack having a closed rectangular-like shape and having one end of the rack folded downward to permit placement of the rack in holding grooves in the oven walls.

Holding: as used herein, is the act of grasping by one's hand and maintaining that grasping by an individual.

Metal: as used herein is any metallic material, or metallic alloy that can be bent, cast, or otherwise formed into a specific shape and retain that shape over time. These materials include but are not limited to steel, iron, aluminum, copper, and brass.

Open Frame: as used herein, as used herein, refers to a frame structure that could be likened to a letter "E". One example of a device comprising an open frame structure would be a device for hanging items, such as a kind of coat rack that attaches to a wall or a bookcase or shelve system that has a framed in structure without having a back or front piece.

Prone: as used herein refers to reclining position where the back of the individual is in contact with the floor or other flat surface.

A List of the Reference Numbers and Related Parts of the Invention

10 A hamstring stretching apparatus according to the principles of the present invention.

12 A frame of the current invention.

12*a-c* Segments of frame assembly 12.

12*d* Support segment that is part of frame assembly 12.

13 Means for supporting the front sole of a foot.

14 Means for supporting the back ankle part of a foot.

15 Means for keeping a leg straight.

16 Means for holding; as illustrated, the means for holding is a handle.

17 Aperture part of size adjustment means, which as illustrated are apertures formed in the frame 12 for adjustment purposes.

18 Bolt-like part of size adjustment means.

19 Padding.

20 A hamstring stretching apparatus according to the principles of the present invention.

22 A frame of the current invention.

22*a* Means for user to hold frame.

24 Means for keeping user's leg straight.

24*a* Size-adjustable hamstring stretching apparatus means for keeping user's leg straight.

26 Means for supporting sole of a foot.

26*b* Size-adjustable hamstring stretching apparatus means for supporting sole of foot.

28 Means for supporting ankle.

28*c* Size-adjustable hamstring stretching apparatus means for supporting ankle.

30 A size-adjustable hamstring stretching apparatus according to the principles of the present invention.

30*a* A first frame part of size-adjustable hamstring stretching apparatus 30.

30*b* A second frame part of size-adjustable hamstring stretching apparatus 30.

32*a*-32*c* Apertures for receiving compressible, spring action locking pin 32*d*.

32*d* Compressible, spring action locking pin 32*d*.

34 First end of first frame part of 30*a*.

36 First end of second frame part of 30*b*.

40 A foldable hamstring stretching apparatus according to the principles of the present invention.

40*a* A first frame part of foldable hamstring stretching apparatus 40.

40*b* A second frame part of foldable hamstring stretching apparatus 40.

40*c* A third frame part of foldable hamstring stretching apparatus 40.

42*a*-42*d* Hinged attachments.

50 A folding size-adjustable hamstring stretching apparatus according to the principles of the present invention.

It should be understood that the drawings are not necessarily to scale. In certain instances, details which are not necessary for an understanding of the present invention or which render other details difficult to perceive may have been omitted. It should be understood, of course, that the invention is not limited to the particular embodiments illustrated herein, but is disposed to embodiments in various sizes, shapes, and forms and, thus, encompasses many embodiments as are discussed throughout the specification. Therefore, the embodiments described herein are provided with the understanding that the present disclosure is intended as illustrative and are not intended to limit the invention.

DETAILED DESCRIPTION

Figure 1:
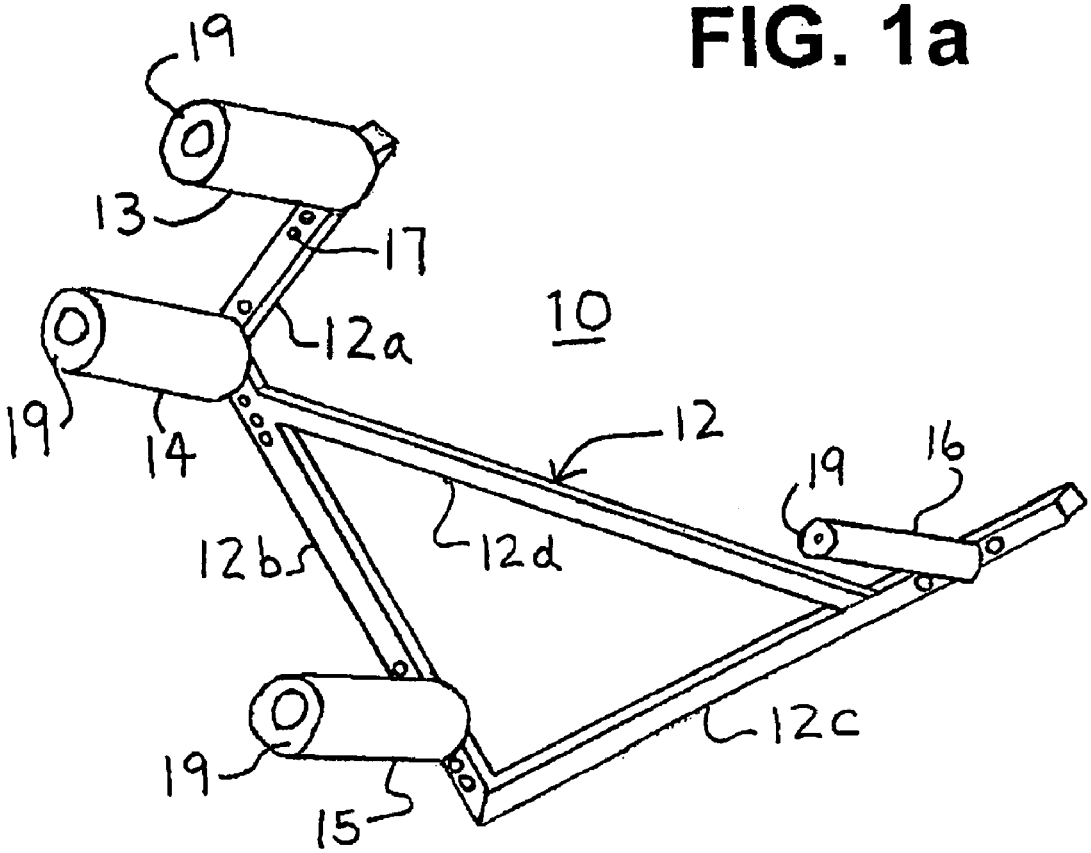
FIG. 1 is a perspective view of the hamstring stretching apparatus according to the principles of the present invention.

Referring now particularly to the drawings, FIG. 1 represents a perspective side view of the hamstring stretching apparatus 10, which is an exemplary embodiment of the invention. Apparatus 10, as illustrated, demonstrates how the above mentioned disadvantages have been overcome.

FIG. 1 illustrates an apparatus for stretching hamstring muscles in a prone position, comprising:

a) means for holding 16;

b) means for supporting a foot 13 and 14, and c) means for keeping a knee joint from bending 15, wherein the means for holding, the means for supporting a foot, and the means for keeping a knee joint from bending are functionally connected to form one-piece frame 12.

More specifically, apparatus 10, as exemplified, may be made of unitary frame 12. Frame 12 may be described as being divided into four segments 12*a*-12*d* that are joined together to form one piece. Segments 12*a*-12*c* function, in part, as attachment areas for the attachment of means for holding 16, means for supporting a foot 13 and 14, and means for keeping a knee joint from bending 15. Segment 12*d* functions to provide support to connected segments 12*a*-12*c*. It is obvious to a person having ordinary skill in the art that the support segment 12*d* would be necessary only if the materials used in the manufacturing of frame 12 were such that support was required. Thus, support segment 12*d* may be omitted, provided the materials used in the manufacturing of the frame 12 were rigid and strong enough to prevent bending even with excessive use. It should also be noted that the numbering division of segments 12*a*-12*d* is purely for illustrative purposes only, and a person having ordinary skill in the art would realize that the entire frame may, and is contemplated to, be cast as one piece to embody the essence of this invention.

Frame 12 can be made from any functional material, such as a metal, and be formed by any known, or yet to be known method for forming such objects, such as by using a casting method, a forged method, or otherwise formed into the desired shape. In a preferred embodiment, the metal may be aluminum. However, a person having ordinary skill in the art would also realize that any metal, semi-metallic material or metal alloy that has the requisite properties may be used. Moreover, any suitable plastic, plasticized alloy, or fiberglass may be used to manufacture the apparatus. Injection type molding is one favored manufacturing method.

Attached to frame 12, as shown in FIG. 1, are three means, a means for holding 12 using one's hands, two means for supporting a foot 13 and 14, and a means for maintaining a straight leg 15. As illustrated in FIG. 1*a* (using means 13 to illustrate), each of means 13 to 16 are equipped with bolt-like projections 18 that are designed to be accepted by attachment apertures 17 for the attachment of means 13 to 16 to frame 12, as illustrated in the drawings. Although bolt-like attachments means are used in the invention as illustrated, any other effective and desired means of attachment may also be used.

One means part for supporting a foot 13 is functionally positioned and attached to frame segment 12*a*. The other means part for supporting a foot 14 may be functionally positioned on and attached to frame segment 12*a* or to 12*b* to provide for the support, and the secure holding, of the foot of the person using the apparatus. The size of the person wishing to use the apparatus determines on which segment and to which aperture the means should be attached. Means for maintaining a straight leg 15 is essentially a biasing rest that is functionally positioned on the length of segment 12*b* to provide biasing support for a user's knee when his or her foot is properly aligned in supports 13 and 14. The means for maintaining a straight leg biases a user's knee in the direction of the back of the user's leg providing for the leg to be maintained in a straight line by preventing the knee from bending. This is a fundamental improvement over the apparatuses presently available, which permit the knee to bend, thus providing an ineffective stretch to the hamstrings.

Also attached to frame 12 is handle 16 which is contemplated to be held by the hand(s) of the user of the apparatus. While being held by a user, handle 16 provides assistance and support to the person using the apparatus. Means 13-16 may be made out of any functional material, however in one preferred embodiment they would be made of plastic or aluminum. Also in a preferred embodiment, means 13-16 are supplied with padding 19 to provide for the comfort of a user. Padding may be made of any particular material desired, with a person having ordinary skill in the art realizing that the padding can be of any functional material, and applied in any utilitarian fashion, and still be within the spirit of the invention.

Figure 2:
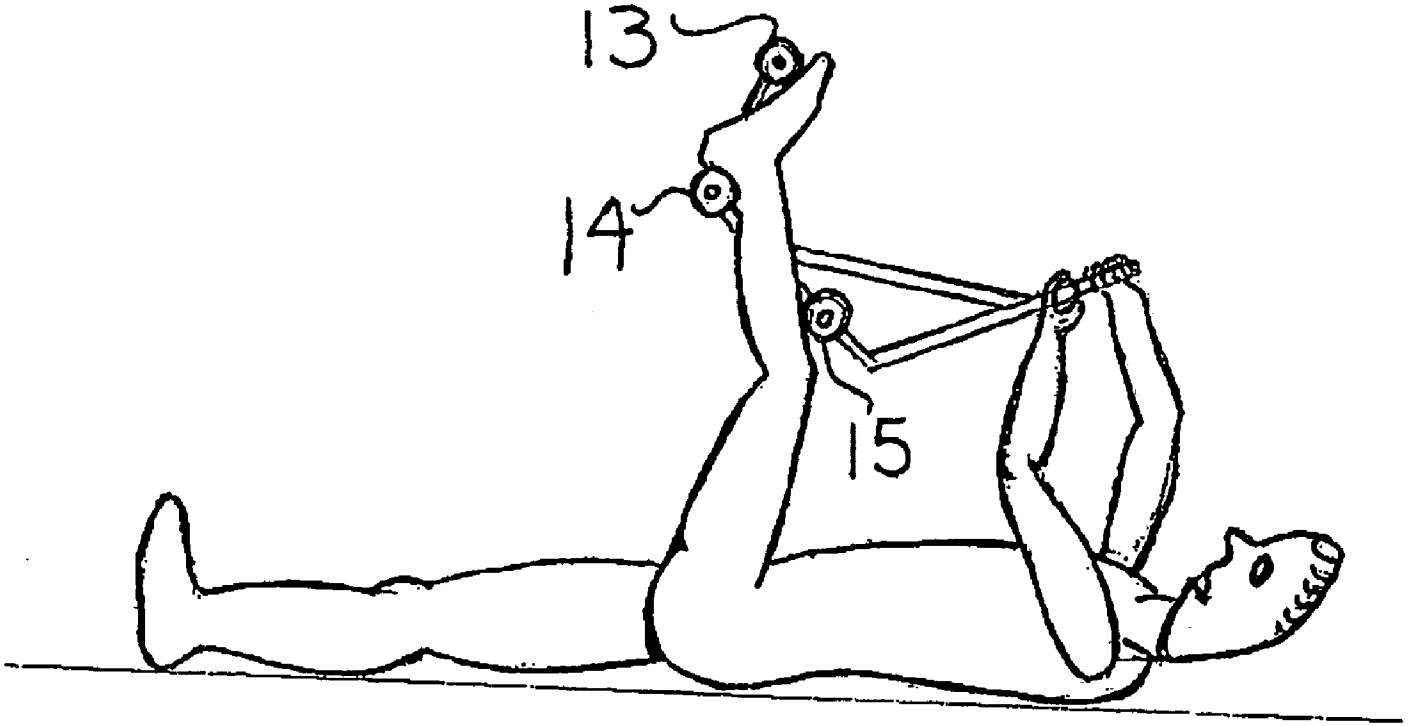
FIG. 2 is a perspective view showing the hamstring stretching apparatus as shown in FIG. 1 in use.

FIG. 2 illustrates how the apparatus is used for stretching an individual's hamstrings. As shown in FIG. 2, the user positions himself or herself in a prone position to use the apparatus. Executing the stretch while lying prone, reduces stress on the back muscles, as opposed to some related art apparatuses that require a user to bend over from a standing position and thus to place stress on the user's back muscles. Apparatus 10 should be positioned so that the ball-section of a user's foot is located on means 13, as illustrated in FIG. 2. Foot support means part 14 should be located behind the upper part of the heel of the foot. Means 15, which part is to maintain the user's leg in a straight position, should be positioned on the front of the leg, just above the knee. Handle 16 is then grasped by the user. At this point, the user can do either a passive stretch, by pulling up on handle 16, which pulling causes means 13-15 to move simultaneously upward and forward, which movement applies leverage to the user's leg and stretches the hamstring. Another way to use hamstring stretching apparatus 10 is in an isometric fashion. This is accomplished by a method that is similar to the passive stretch, except that instead of pulling on the handle 16, the user pushes on the handle for a number of seconds, and then relaxes the push for a number of seconds. This movement may be repeated as often as desired. This exercise may be made more rigorous by raising the leg upwards by some increment and repeating the push and relax routine. While these are two preferred exercises that may be used with hamstring stretching apparatus 10, the apparatus is not limited to only those exercises, and a person having ordinary skill in the art would recognize that any type of hamstring stretching exercise may be done with the hamstring stretching apparatus 10.

Figure 3:
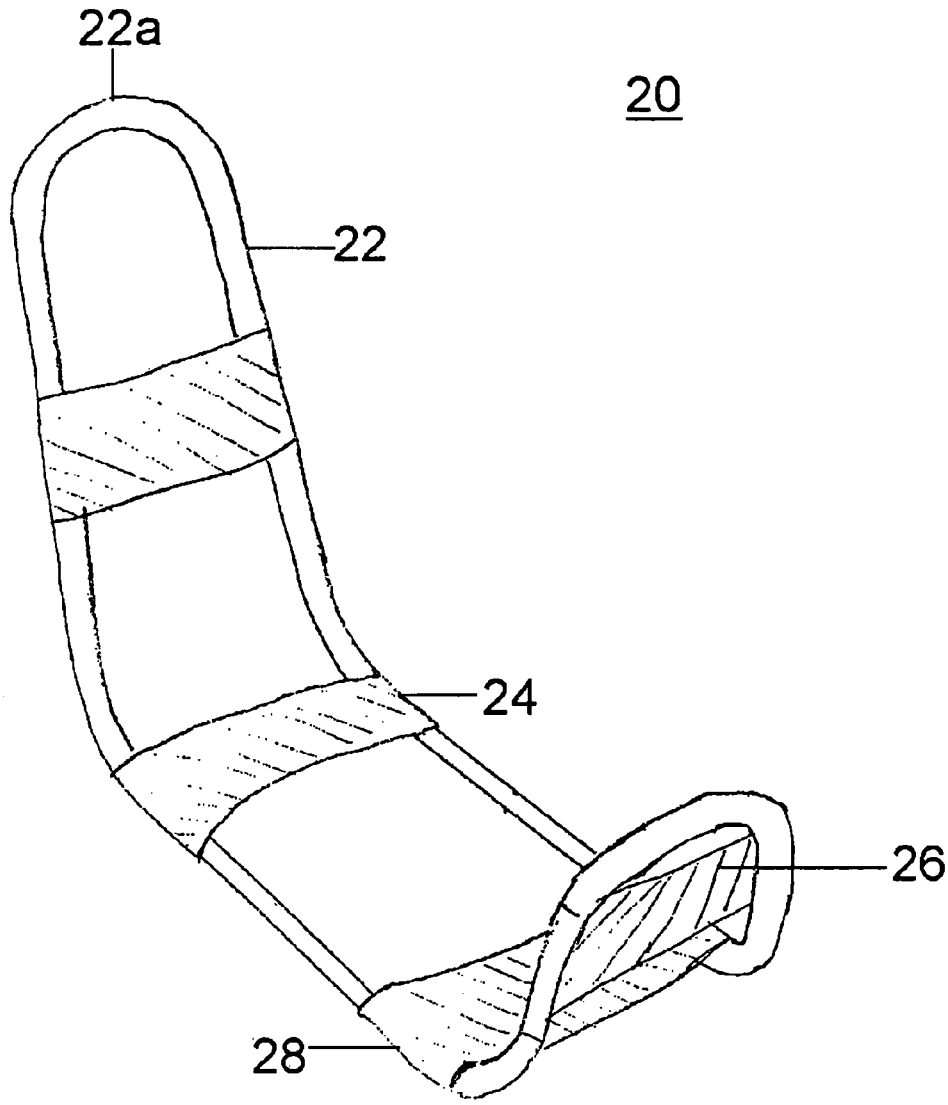
FIG. 3 is a perspective view of another hamstring stretching apparatus, made according to the principles of the present invention.

FIG. 3, a perspective view, illustrates an alternate design of hamstring stretching apparatus 20, made according to the principles of the present invention. Like the apparatus illustrated in FIGS. 1-2, FIG. 3 illustrates an apparatus for stretching hamstring muscles in a prone position, comprising a means for holding, a means for supporting a foot, and a means for maintaining a straight leg functionally interconnected forming an apparatus comprising a unitary frame structure. In this design, the frame structure comprises a shaped rectangular, closed frame 22 having means for holding 22*a*, means for keeping user's leg straight 24, means for supporting a sole of a foot 26, and means for supporting the back of an ankle 28. Frame 22, as illustrated in FIG. 3, differs from frame 12, as illustrated in FIGS. 1-2, only in that frame 22 forms a closed shaped frame structure wherein frame 12 forms an open frame. The style of frame chosen is a matter of taste as both frames perform the same function in the same way with essentially the same structure. Frame 22 offers several cloth-like strips of material, each strip having a first and a second end, where the first end of each strip is attached to one side of the shaped, rectangular-like frame and a second end of the same strip is attached to the opposite side of the shaped, rectangular-like frame. One such strip provides for keeping user's leg straight 24, a second strip provides for supporting a sole of a foot 26, and a third strip provides for supporting the back of an ankle 28.

Figure 4:
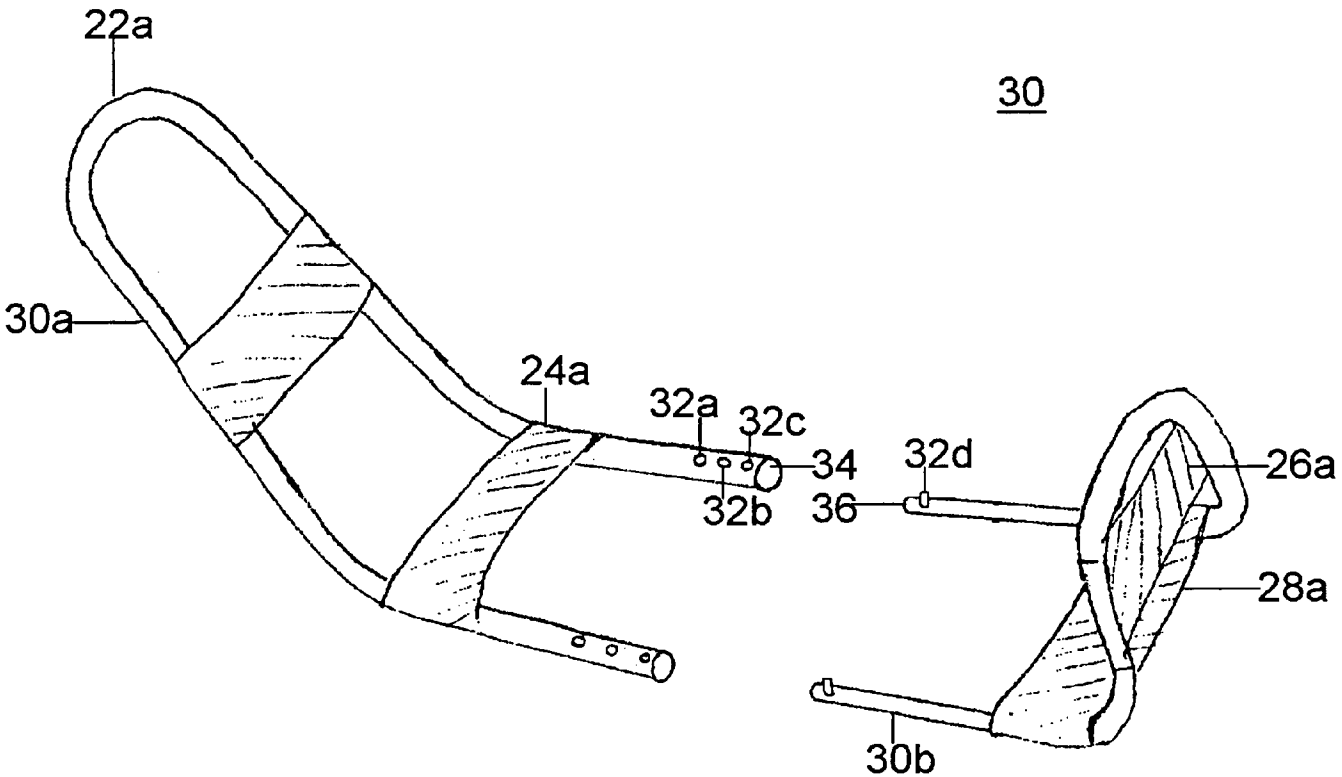
FIG. 4 is a perspective view of the two parts of the size-adjustable hamstring stretching apparatus, made according to the principles of the present invention, before one part is slideably received by the other part for lockable sized adjustment.

FIG. 4, a perspective view, Illustrates size-adjustable hamstring stretching apparatus 30, made according to the principles of the present invention, having first frame part 30*a*, and a second frame part 30*b*, where the second frame part is reversibly separable from the first frame part. First frame part 30*a* having first end 34 adapted for slideably receiving and reversibly maintaining first end 36 of second frame part 30*b* providing for size adjustability of the unitary frame. First end 36 of second frame part 30*b* further comprises at least one compressible, spring-like locking pin means 32*d* functionally positioned on first end 36 of second frame part 30*b*. At least two apertures 32*a*-32*c* are functionally positioned on first end 34 of first part 30*a* for receiving at least one spring-like, compressible, spring-like locking pin means 32*d* providing for lockable size adjustability of said apparatus. When compressible, spring-like locking pin means 32*d* is received by aperture 32*a* the spring action of the locking pin provides for the frame to be securely adjusted for use by a user of shorter stature. When locking pin means 32*d* is received by aperture 32*c* the spring action of the locking pin provides for the frame to be secured locked in position for use by a user having longer limbs. The number of apertures in any one frame may be as desired. It is to be understood that the adjustable locking means illustrated in the favored embodiment illustrated in FIG. 4 is but one of many locking means that may be employed. Those of ordinary skill in the art of providing for reversible connections will be familiar with the many other types of locking means commonly available, and thus such alternate locking means, while contemplated for use with the present invention, need not be discussed further here.

Figure 5:
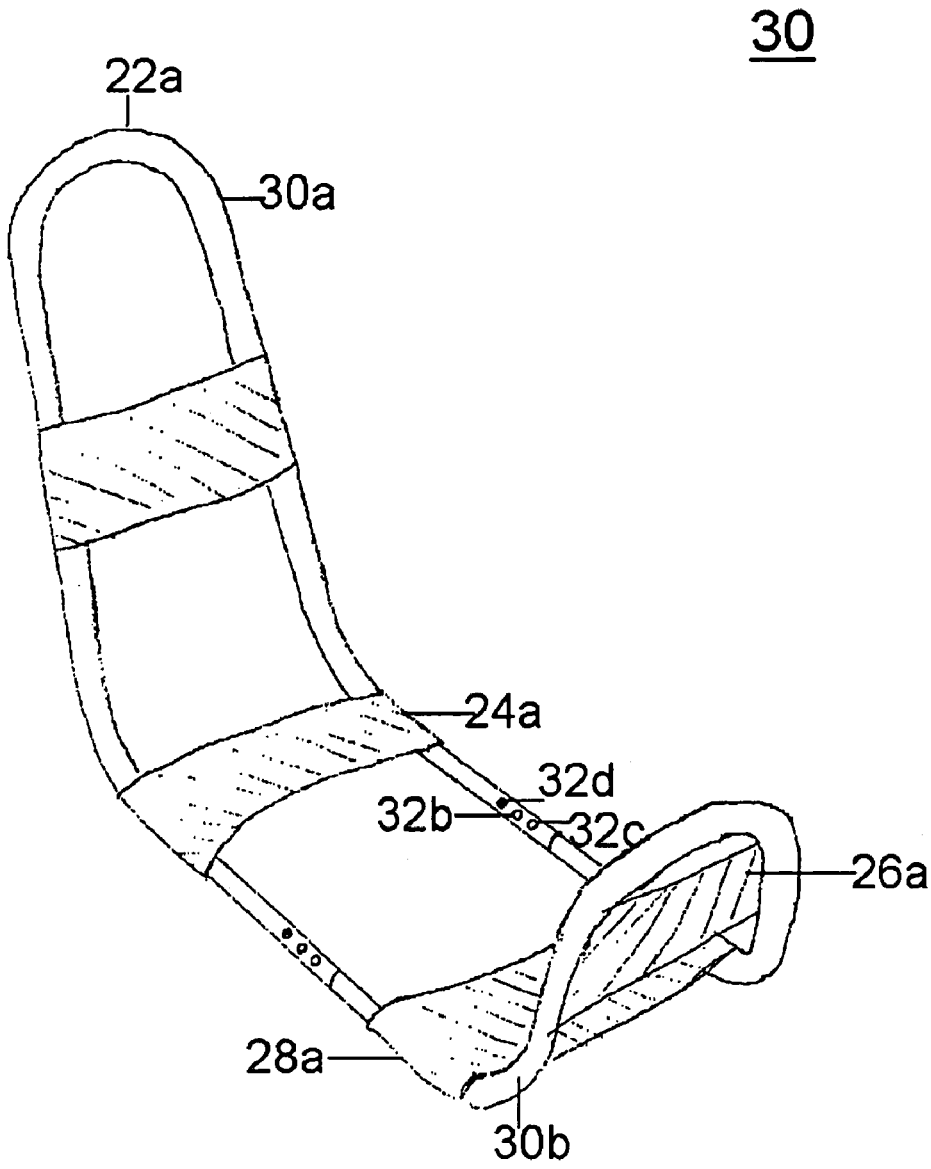
FIG. 5 is a perspective view of the two parts of the size-adjustable hamstring stretching apparatus, as illustrated in FIG. 4, after one part is slideably received by the other part and locked for lockable sized adjustment.

FIG. 5, a perspective view, illustrates the two parts of the size-adjustable hamstring stretching apparatus, as illustrated in FIG. 4, after one part is slideably received by the other part and the parts are locked together providing for lockable sized adjustment of the hamstring stretching apparatus.

Figure 6:
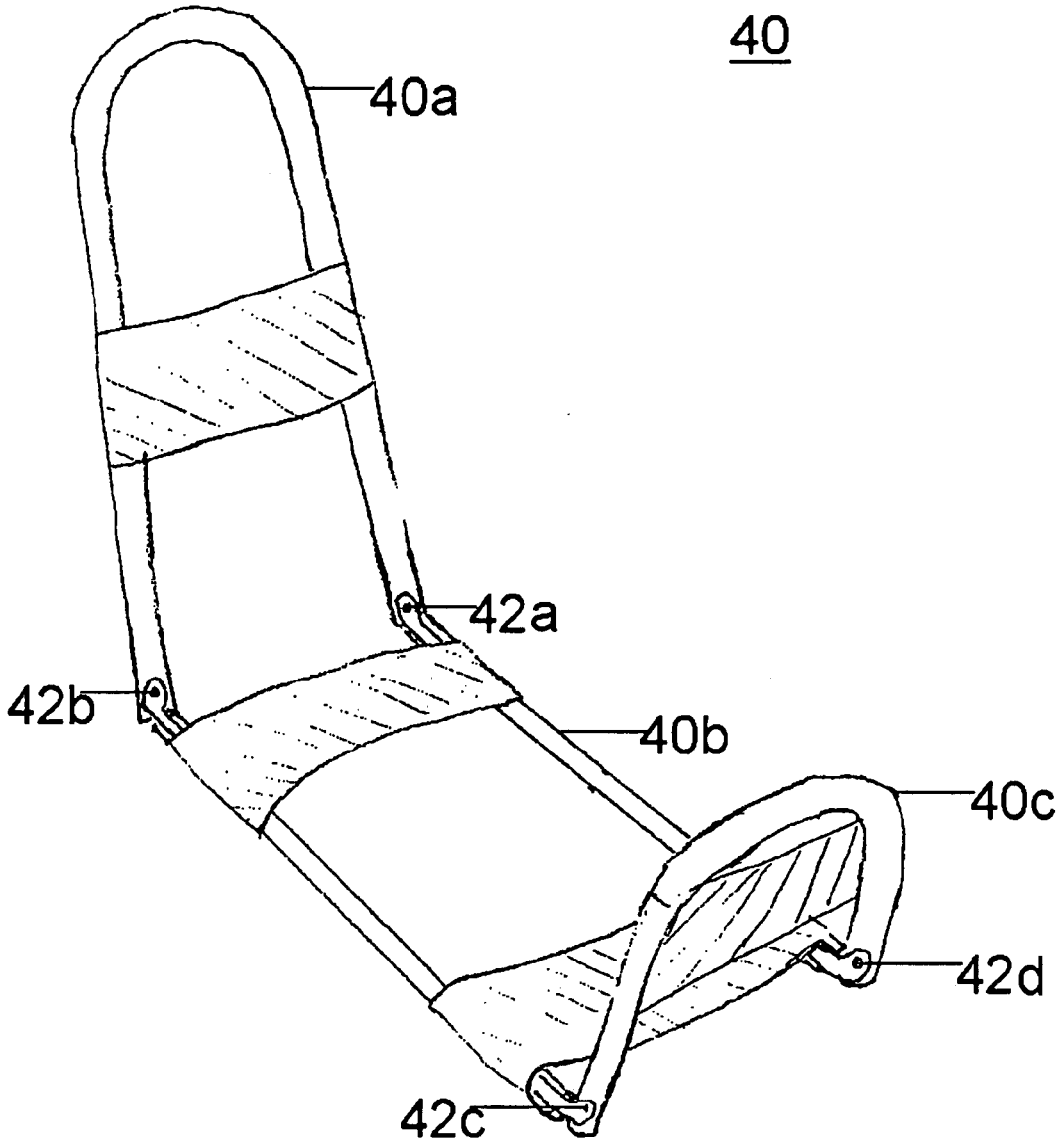
FIG. 6 is a perspective view illustrating a foldable hamstring stretching apparatus, made according to the principles of the present invention.

FIG. 6, a perspective view, illustrates foldable hamstring stretching apparatus 40, made according to the principles of the present invention where first frame part 40*a* of foldable hamstring stretching apparatus 40 is hingedly attached to second frame part 40*b* via attaching hinges 42*a* and 42*b*. Second frame part 40*b* in turn is hingedly attached to third frame part 40*c* of foldable hamstring stretching apparatus 40 via attaching hinges 42*c* and 42*d*. The hinged attachments provide for the hamstring stretching apparatus to be folded. Depending on the type of attaching hinges used the apparatus may be folded in any number of configurations. One such configuration is to fold the first frame part over the second frame part and then folding the third frame part over the folded first frame part. Regardless of how the frame parts are folded over or under each other, a folded hamstring stretching apparatus is compact enough to fit into a small suitcase.

Figure 7:
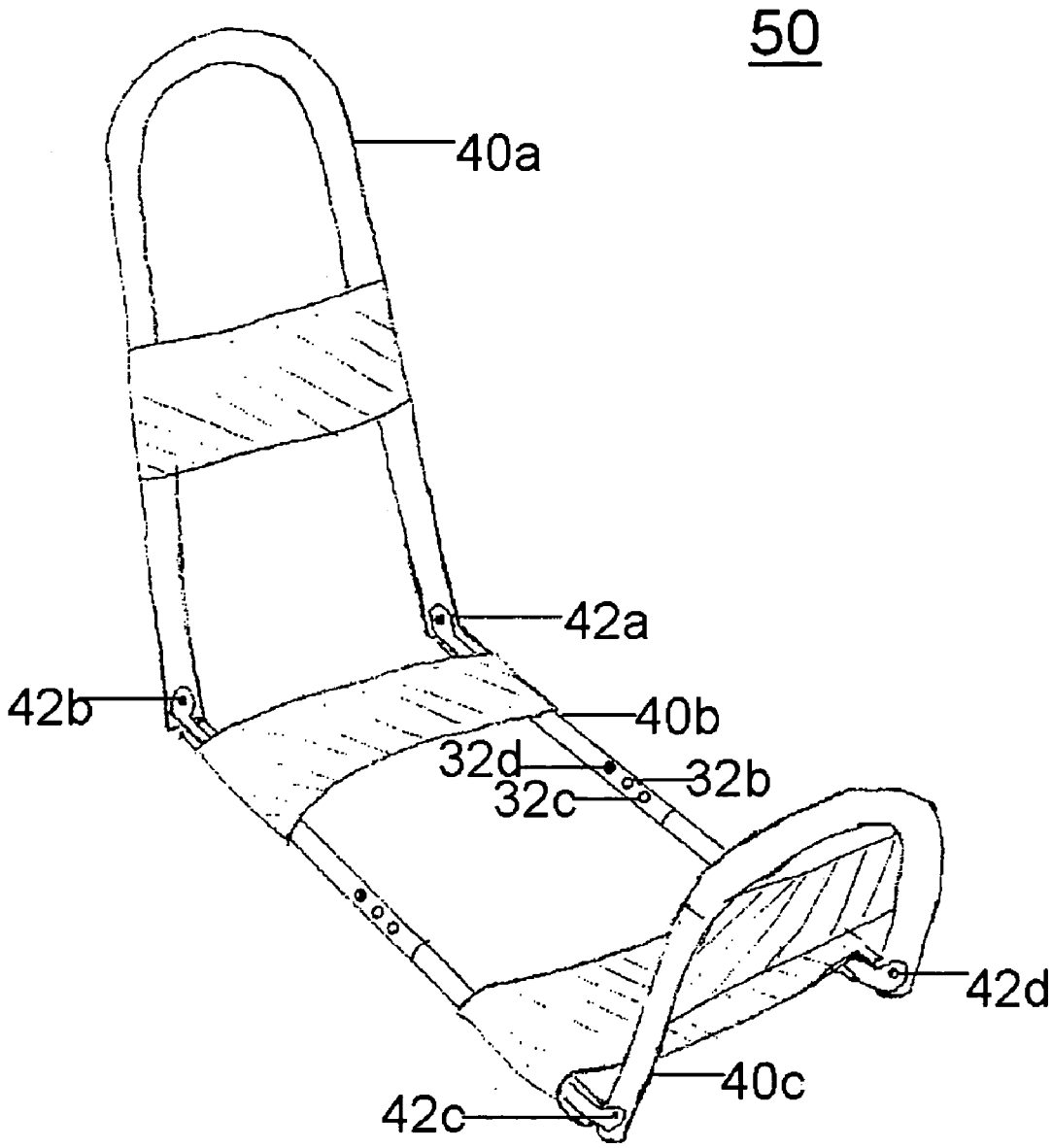
FIG. 7 is a perspective view illustrating a size-adjustable foldable hamstring stretching apparatus.

FIG. 7 is a perspective view illustrating a size-adjustable foldable hamstring stretching apparatus 50 that may be adjusted for size and folded for easy transport, as described above.

Figure 8:
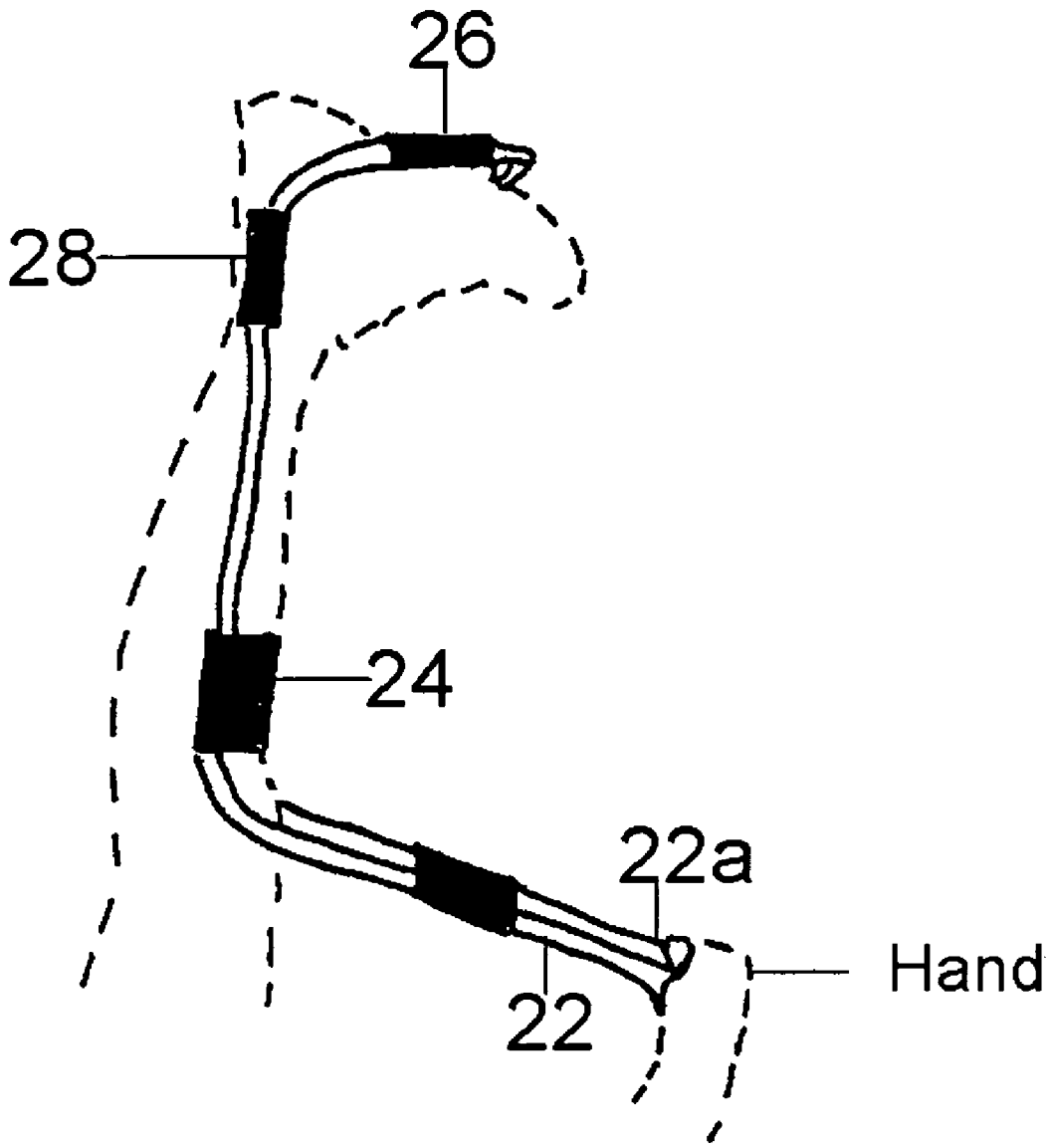
FIG. 8 is a perspective view illustrating a size-adjustable foldable hamstring stretching apparatus in use.

FIG. 8 is a perspective view illustrating how to use a size-adjustable foldable hamstring stretching apparatus, as illustrated in FIG. 3.

It has been shown then that hamstring stretching apparatus made according to the principles of the present invention solves the problems presented by currently available apparatus. For one, the invention according to what has been taught, eliminates the need for an additional person or apparatus to maintain a user's leg in a straight position, which is a substantial improvement over other apparatus. Moreover, hamstring stretching apparatus as taught herein is light weight, has no moving parts, is size adjustable, and may be folded, which are all improvements over the current state of the art. Importantly, the invention provides for an apparatus that is easy to make out of easily available materials and by inexpensive methods of manufacture, making the apparatus affordable to all. Moreover, the hamstring stretching apparatus of the present invention provides for perfect hamstring stretching without stressing the back, use without a partner, keeps the user's leg straight by preventing bending of the knee, and provides for stretching of the calf at the same time the hamstring muscle is being stretched.

The foregoing description, for purposes of explanation, used specific and defined nomenclature to provide a thorough understanding of the invention. However, it will be apparent to one skilled in the art that the specific details presented are not required in order to practice the invention and are not intended to be exhaustive or to limit the invention to the precise forms disclosed. Those skilled in the art will recognize that many changes may be made to the features, embodiments, and methods of making the embodiments of the invention described herein without departing from the spirit and scope of the invention. The invention is limited only by the claims.

What is claimed is:

1. An apparatus for stretching hamstring muscles in a prone position, comprising:

a unitary frame, said frame describing an elongated rectanaular-like frame having two parallel sides, a first end having a general u-shape, and a second end having a general u-shape, said first end bent toward said second end, said second end bent toward said first end, said frame providing a means for holding;

a first band stretched between and attached to opposing side portions of said two parallel sides proximate to where said first end bends toward said second end providing for a means for supporting a foot, and a second band of a cloth-like strip of material stretched between and attached to opposing side portions of said two parallel sides proximate to where said second end bends toward said first end providing for a means for maintaining a straight leg positioned on the leg above the knee.

2. The apparatus, as recited in claim 1, further comprising wherein said unitary frame apparatus is size adjustable.

3. The apparatus, as recited in claim 2, wherein said unitary frame further comprises:

at least a first part, and at least a second part, said second part reversibly separable from said first part, said first part having a first end adapted for slideably positionably receiving and reversibly maintaining a first end of said second part providing for size adjustability of said unitary frame.

4. The apparatus, as recited in claim 3, further comprising:

at least one locking pin means functionally positioned on said first end of said second part, and at least two apertures functionally positioned on said first end of said first part for receiving said at least one locking pin providing for lockable size adjustability of said apparatus.

5. The apparatus, as recited in claim 1, further comprising wherein said apparatus is foldable.

6. The folding apparatus, as recited in claim 5, further comprising:

a first frame part;

a second frame part, and a third frame part, wherein said first frame part is hingedly attached to second frame part via attaching hinges, wherein second frame part is hingedly attached to third frame part via attaching hinges, wherein said hinged attachments provide for the hamstring stretching apparatus to be foldable.

7. The apparatus, as recited in claim 1, further comprising wherein said frame is made of a metal.

8. The apparatus, as recited in claim 1, further comprising wherein said frame is made of a plastic.

9. A method for stretching hamstrings in a prone position, comprising the steps of:

providing a unitary frame, said frame describing an elongated rectangular-like frame having two parallel sides, a first end having a general u-shape, and a second end having a general u-shape, said first end bent toward said second end, said second end bent toward said first end, said frame providing a means for holding;

providing a first band stretched between and attached to opposing side portions of said two parallel sides proximate to where said first end bends toward said second end providing for a means for supporting a foot, and providing a second band of a cloth-like strip of material stretched between and attached to opposing side portions of said two parallel sides proximate to where said second end bends toward said first end providing for a means for maintaining a straight leg said second band positioned on the lea above the knee, supporting the foot in said means for supporting a foot, maintaining a straight leg using said means for maintaining a straight leg by positioning said second band on the lea above the knee, holding said means for holding, and lifting the foot supported in said means for supporting the foot upwards using said means for holding therein stretching the hamstrings.

10. The method, as recited in claim 9, further comprising wherein said unitary frame is size adjustable.

11. The method, as recited in claim 10, further comprising wherein said size adjustable unitary frame apparatus comprises:

a first frame end, and a second frame end, wherein said second frame end is designed to fit into said first frame end providing for size adjustability of said unitary frame apparatus.

12. The method, as recited in claim 11, further comprising:

at least one locking pin functionally positioned on said second frame end, and at least two apertures functionally positioned on said first frame end for receiving said at least one pin providing for lockable size adjustability of said unitary frame apparatus, wherein once said at least one locking pin is received by one of said apertures said second frame end is locked into said first frame end, providing for said unitary frame apparatus to be size adjustable.

13. The method, as recited in claim 9, further comprising wherein said apparatus is foldable.

14. The method, as recited in claim 10, further comprising a third band stretched between and attached to opposing side portions of said two parallel sides proximate to said second end providing for a means for supporting the bottom of a foot.

15. The method, as recited in claim 9, further comprising wherein the frame apparatus is made of a metal.

16. The method, as recited in claim 9, further comprising wherein the frame apparatus is made of a plastic.

17. A one-piece foldable apparatus for stretching hamstrings, comprising:

A frame, said frame describing a closed elongated rectangular-like frame having two parallel sides, a first end having a general u-shape, and a second end having a general u-shape, said first end bent toward said second end, said second end bent toward said first end, said frame providing a means for holding;

a first band stretched between and attached to opposing side portions of said two parallel sides proximate to said first generally u-shaped end providing for a means for supporting a foot, and a second band of a cloth-like strip of material stretched between and attached to opposing side portions of said two parallel sides proximate to said second generally u-shaped end providing for a means for maintaining a straight leg said second band positioned on the leg above the knee.

18. The folding apparatus, as recited in claim 17, further comprising:

a first frame part;

a second frame part, and a third frame part, wherein said first frame part is hingedly attached to second frame part via attaching hinges, wherein second frame part is hingedly attached to third frame part via attaching hinges, wherein said hinged attachments provide for the hamstring stretching apparatus to be foldable.

19. The folding apparatus as recited in claim 18, further comprising a means for size-adjusting comprising:

a first frame end, and a second frame end, wherein said second frame end is designed to fit into said first frame end providing for size adjustability of said folding apparatus.

20. The folding apparatus as recited in claim 19, further comprising:

at least one locking pin functionally positioned on said second frame end, and at least two apertures functionally positioned on said first frame end for receiving said at least one pin providing for lockable size adjustability of said unitary frame apparatus, wherein once said at least one locking pin is received by one of said apertures said second frame end is locked into said first frame end, providing for said folding apparatus to be size adjustable.

* * * * *